United States Patent [19]

White

[11] Patent Number: 4,563,937

[45] Date of Patent: Jan. 14, 1986

[54] GAS ACTUATED PISTOL

[75] Inventor: Bernard C. White, Robbinsdale, Minn.

[73] Assignee: Magnum Research, Inc., Minneapolis, Minn.

[21] Appl. No.: 455,506

[22] Filed: Jan. 4, 1983

[51] Int. Cl.[4] ..... F41C 5/02

[52] U.S. Cl. ..... 89/185; 42/75 A

[58] Field of Search ..... 89/185, 191 R, 184, 89/188, 193, 194, 196; 42/75 R, 75 A, 75 B, 75 C

[56] References Cited

U.S. PATENT DOCUMENTS

| | | | |
|---|---|---|---|
| 1,395,141 | 10/1921 | Reising | 42/75 B |
| 1,430,662 | 10/1922 | Lewis | 89/185 |
| 2,468,784 | 5/1949 | Seagraves | 89/185 |
| 2,817,174 | 12/1957 | Liedke | 42/75 B |
| 3,069,976 | 12/1962 | Stevens | 89/196 |
| 3,273,460 | 10/1966 | Mason | 89/185 |
| 3,306,168 | 2/1967 | Blumrick | 89/191 |
| 3,657,960 | 4/1972 | Badali | 89/191 A |
| 3,675,534 | 7/1972 | Beretta | 89/185 |
| 3,969,983 | 7/1976 | Zellweger et al. | 89/185 |
| 3,988,964 | 11/1976 | Moore | 89/185 |
| 3,996,684 | 12/1976 | Bauman et al. | 89/185 |
| 4,279,141 | 7/1981 | Johansson | 89/185 |

FOREIGN PATENT DOCUMENTS

| | | | |
|---|---|---|---|
| 195365 | 4/1938 | Switzerland | 89/196 |
| 1601 | of 1907 | United Kingdom | 89/196 |

OTHER PUBLICATIONS

Smith et al., Small Arms & Cannons, "Gas Operation", 1982, pp. 145–147, 150.

*Primary Examiner*—Stephen C. Bentley

*Attorney, Agent, or Firm*—James V. Lilly

[57] ABSTRACT

A fully gas actuated pistol comprising a frame assembly adapted to fixedly receive a barrel assembly and slidably receive a bolt carrier assembly is disclosed. The barrel assembly is supported and locked at both its muzzle and breach ends. The pistol provides increased bullet velocity, reduced recoil and improved accuracy.

7 Claims, 27 Drawing Figures

101
103
165
121
122
117
129
123
116

106
105
104
108
107
109
110
164
127
125
123
119
118
121
122
117
8
8
139
138
137
142
132
134
141
131
130

101
165
122A
110
121
129
122
117

324
337
340
339
338
300
312
314

GAS ACTUATED PISTOL

TECHNICAL FIELD

This invention relates broadly to the field of firearms and particularly to the field of pistols. More particularly it relates to fully gas actuated, automatic and semi-automatic pistols.

BACKGROUND ART

Pistols which utilize a portion of the expanding gasses resulting from burning propellant have been described. For example, some pistols have utilized a portion of the expanding gases to directly impinge upon, and drive, a slide back. See, for example, U.S. Pat. Nos. 3,273,460; 3,306,168; and 3,657,960. Such pistols utilize a relatively large number of parts in the gas actuating system, at least some of which are delicate and unable to withstand prolonged rigorous use. However, pistols of this type are not fully gas operated.

The pistol of the invention, however, provides a fully gas actuated pistol which utilizes a relatively small number of parts. Moreover, it exhibits substantially reduced recoil when compared to other handguns of the same caliber while at the same time imparting higher bullet velocity. The pistol of the invention is fully locked (as will be discussed more fully hereinafter) until the bullet passes a gas-actuating port. This enables compact arrangement of the elements of the pistol and aids in reducing recoil and providing higher bullet velocity. Still further, the pistol of the invention supports and locks the barrel at both the breech and muzzle ends thereby enhancing its accuracy.

DISCLOSURE OF THE INVENTION

In accordance with the present invention there is provided a fully gas-actuated pistol having a frame assembly adapted to lockably receive a barrel assembly and slidably receive a bolt carrier assembly. In the pistol of the invention the gases generated by burning propellant are completely held within the barrel until the bullet passes a gas-actuating port or orifice located near the muzzle end of the barrel through which a portion of the gases are vented from the barrel. These gases force the bolt carrier assembly rearward and essentially simultaneously unlock the bolt so that the spent casing may be ejected and a new casing inserted into the chamber.

Utilizing the gases in this manner significantly increases bullet velocity and significantly reduces recoil. This has obvious advantages with respect to striking power and accuracy.

The pistol of the invention comprises a frame assembly adapted to fixedly receive a barrel assembly and slidably receive a bolt carrier assembly, wherein (a) the barrel assembly comprises a barrel with muzzle and breech ends, a passage through the wall of the barrel near the muzzle end, and front and rear locking assemblies wherein (i) the front locking assembly comprises a housing which defines a chamber closed at one end and open at the other and having an orifice through the wall thereof connecting the chamber to the passage, a piston in the chamber which is slidable between front and rear positions, and front support means thereon;

(ii) the rear locking assembly comprises a projection beneath the breech end of the cylinder having rear support means and locking means thereon;

(b) the bolt carrier assembly comprises a forward barrel-receiving section and a rear bolt-receiving section, the forward section having a lug connecting two vertical side walls, the lug being adapted to slide beneath the barrel assembly between said front and rear locking assemblies of the barrel assembly and (c) the frame assembly comprises a forward trough-shaped portion for receiving the barrel assembly, fastening means for cooperation with the locking means on the barrel assembly, and biasing means in the forward portion;

wherein when the pistol is fired, expanding gases resulting from burning propellant are completely held within the barrel until they reach the passage whereupon a portion of said gases are vented through said passage and said orifice into said chamber and urge said piston from the forward to the rearward position causing said piston to urge said biasing means rearward thereby forcing said bolt carrier assembly rearward.

BRIEF DESCRIPTION OF THE DRAWINGS

The present invention is further described with reference to the accompanying drawings wherein like reference characters refer to the same elements throughout the several views and wherein.

DETAILED DESCRIPTION

Figure 1:
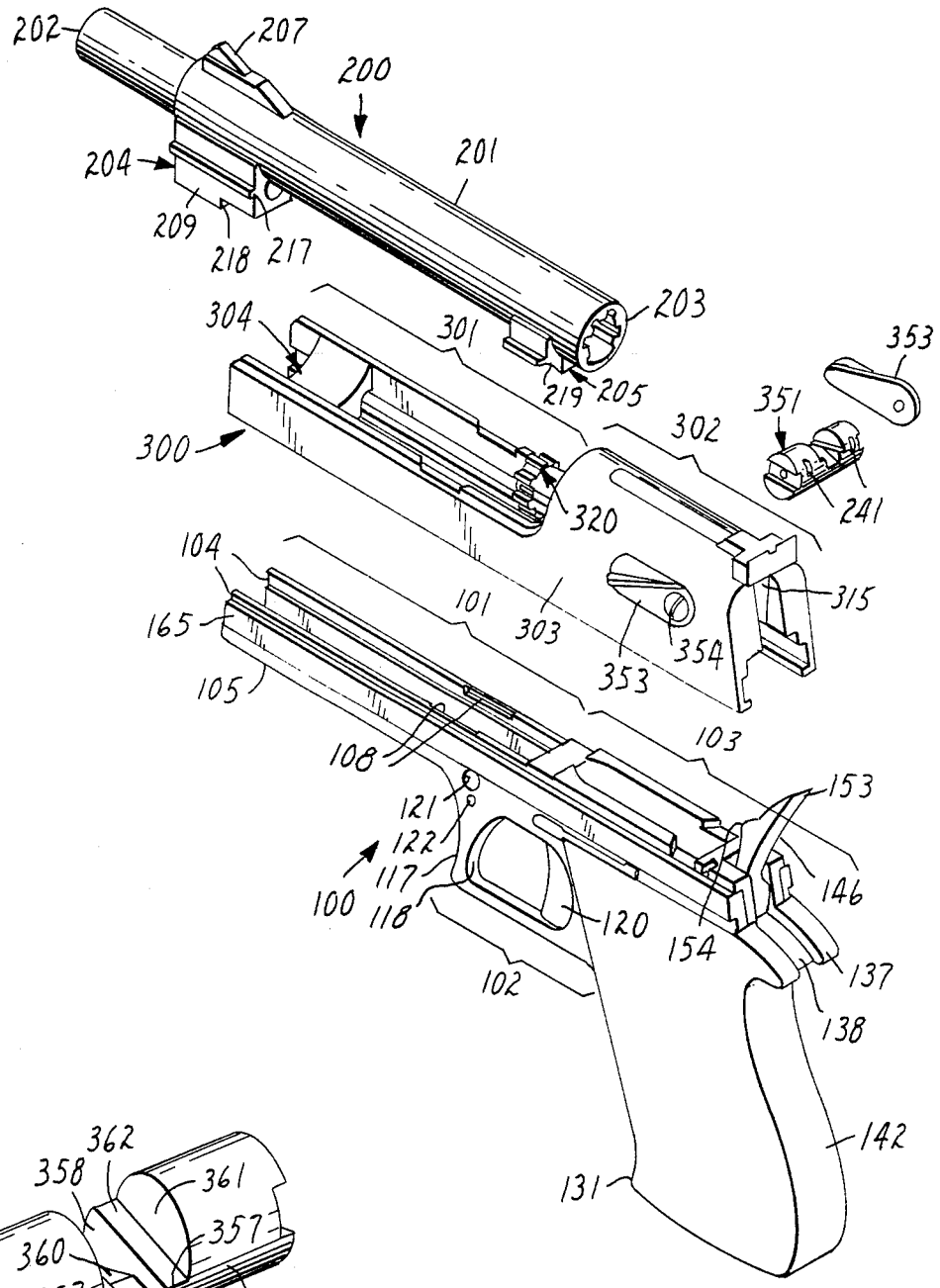
FIG. 1 is an exploded perspective view of a preferred embodiment of the pistol of the invention.

Referring now to the drawings, FIG. 1 shows a preferred embodiment of the invention which comprises a frame assembly 100, a barrel assembly 200, and a bolt carrier assembly 300.

Frame assembly 100, further illustrated in FIGS. 2–9, and 25 comprises barrel-receiving section 101, trigger/-trigger guard section 102, and hand grip section 103. Preferably frame assembly 100 is manufactured from a single piece of metal, such as steel or aluminum.

The barrel-receiving section of the frame assembly (see FIG. 5) has a generally trough-shaped cross-section comprising vertical side walls 104 joined together by base 105. Front bearing means 106 and rear bearing means 107, which are shown here as horizontal grooves, are provided in each of walls 104 to cooperate with the front and rear locking assemblies of the barrel assembly (described hereinafter). Rear bearing means 107 communicates with notches 108 which extend upwardly and out of walls 104 to permit removal of the barrel assembly from the frame assembly. Exterior rails 165 (see FIGS. 1, 7, 8 and 25) are provided along the entirety of the exterior of each of walls 104.

The barrel-receiving section ends in rear wall 109 which has ports 110 for receiving the ends of biasing means 111. See FIGS. 2 and 3. Biasing means 111 comprises springs 112, spring guides 113 with heads 116, assembly plate 114, and retaining clips 115. The assembly plate has two holes therein (not shown) through which the guides pass and is slidable along the guides.

The trigger guard section comprises exterior guard 117 which, in conjunction with the balance of the frame assembly, defines finger opening 118. Recess 119 (see FIG. 5) is provided to receive trigger 120. Transverse holes 121 and 122 are provided through the forward portion of the trigger guard section. These transverse holes cooperate with a locking mechanism (described hereinafter) to lock the barrel assembly in place.

Figures 2, 4, 6:
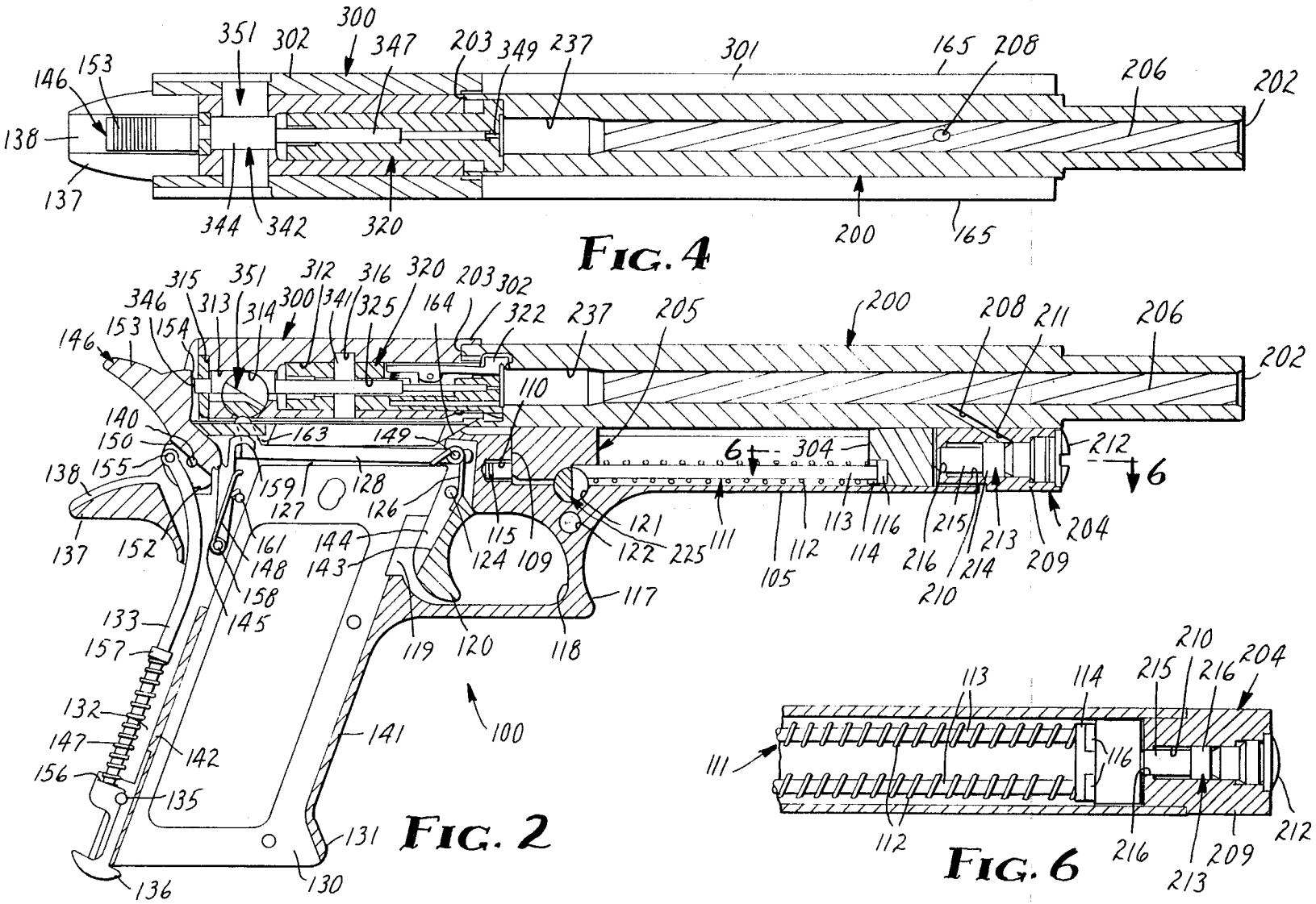
FIG. 2 is a section view of the pistol of FIG. 1 in an assembled state.
FIG. 4 is a top view (in section) of the pistol of FIG. 1 in an assembled state.
FIG. 6 is a section view along line 6—6 of FIG. 2 showing the gas operating system and the biasing assembly.
Figures 3, 16, 17:
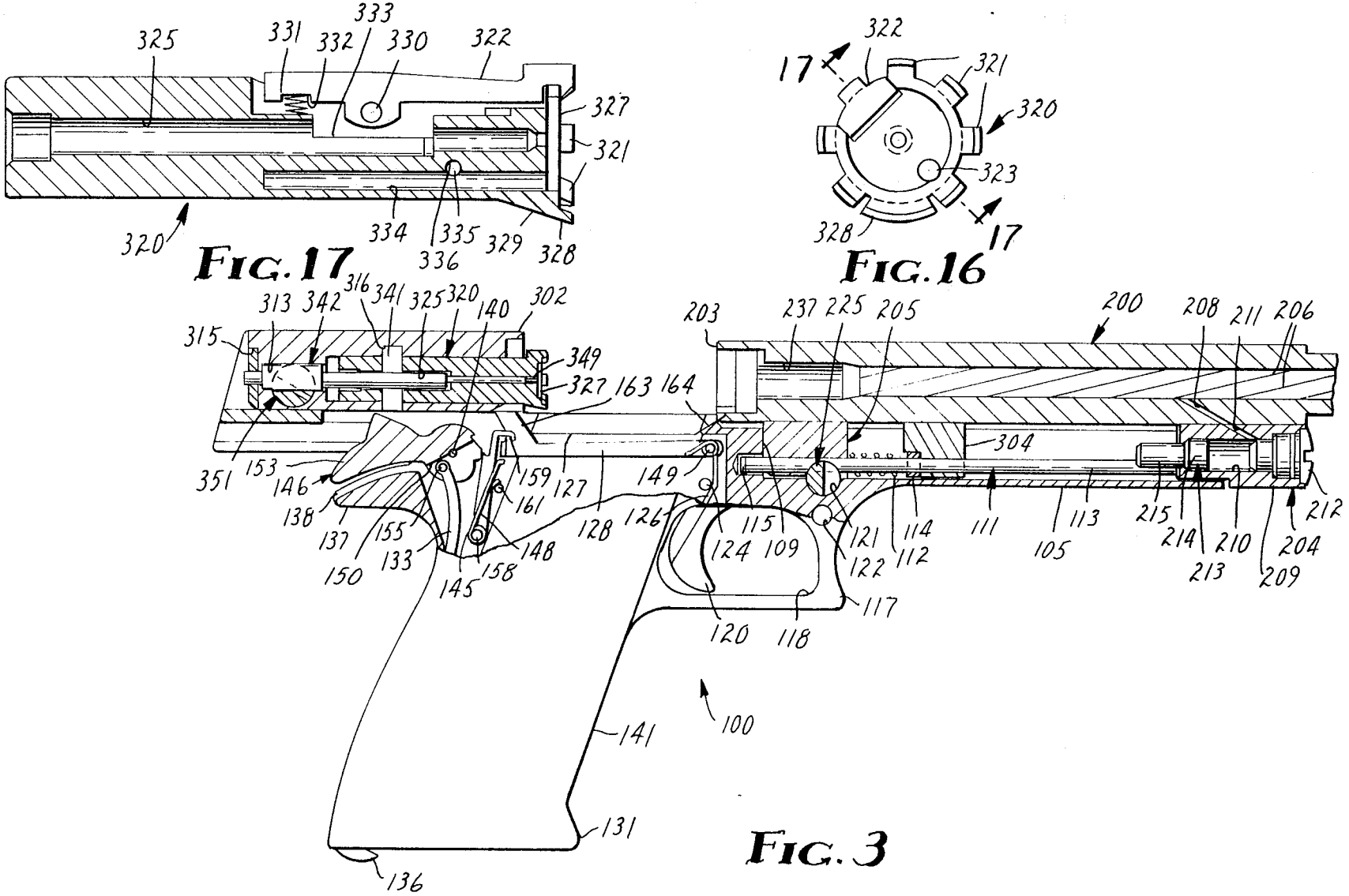
FIG. 3 is a section view of the pistol of FIG. 1 in an assembled state and after it has been fired showing the bolt carrier assembly in a fully rearward position.
FIG. 16 is an end view of the locking end of the bolt of FIG. 15.
FIG. 17 is a section view of the bolt of FIG. 16 taken along line 17—17.

Transverse hole 123 (see FIGS. 5 and 7) is provided in the rearward portion of the trigger guard section to receive trigger pivot pin 124 (see FIGS. 2 and 3). Recess 125 (see FIG. 5) is provided for receiving an assembly including trigger 120 and trigger spring 126 while recess 127 (see FIG. 5) is provided for receiving trigger bar 128.

Figures 5, 7, 8, 18:
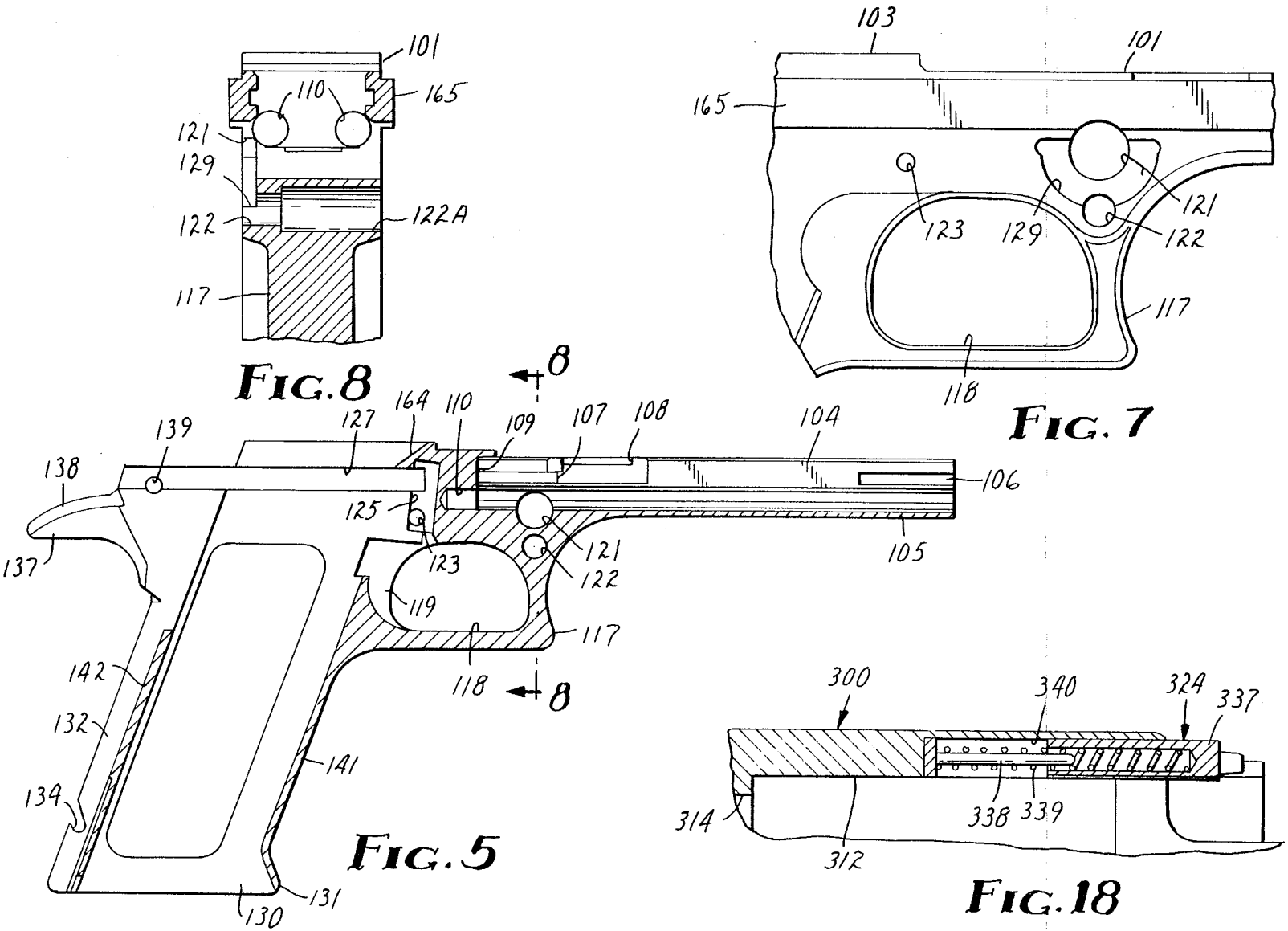
FIG. 5 is a vertical section view of the frame of the pistol of FIG. 1.
FIG. 7 is an enlarged detail view of the right side of the trigger guard portion of the frame of the pistol of FIG. 1.
FIG. 8 is a section view of the trigger guard portion of FIG. 7 taken along line 8—8.
FIG. 18 is a partial section view of the bolt carrier of FIG. 12 showing the detail of the bolt locking mechanism.

FIG. 7 is an enlarged view of the right side of the trigger guard section. Recess 129 is provided which intersects with transverse holes 121 and 122 and is generally semicircular in shape. It forms a portion of the barrel locking mechanism.

Hand grip section 103 is illustrated in FIGS. 2 and 5. It has an inclined magazine well 130 which extends from the bottom to the top of the section. The top of the well terminates in a ramp 164 which facilitates the feeding of a cartridge from a magazine and its insertion into the chamber. The bottom of the well may be flared as shown at 131 to facilitate insertion of a magazine into the well. Recess 132 is provided in the back of the hand grip section for receiving a hammer strut 133. Notch 134 is provided for receiving a positioning pin 135 which holds a magazine catch 136. Rear extension 137 is also provided having hammer-receiving channel 138. Transverse hole 139 is provided for receiving hammer pivot pin 140. Walls 141 and 142 are provided which define the front and back walls of the magazine well.

FIGS. 2, 3, 8 and 9 illustrate the assembly of the trigger and hammer portions of the pistol of the invention. Trigger spring 126 is connected to trigger 120 and trigger bar 128 by pin 149. One end of the trigger spring rests on surface 143 of the trigger while the other end is held in place by a notch (not shown) in the bottom of trigger bar 128 near the front end thereof. The other end of trigger bar 128 interacts with sear lever 145 as is discussed hereinafter. Disconnectors 163, the upper projections of the trigger bar, are also provided. FIGS. 2 and 3 show one half of the trigger bar. The other half of the trigger bar is a mirror image of that shown.

Figure 9:
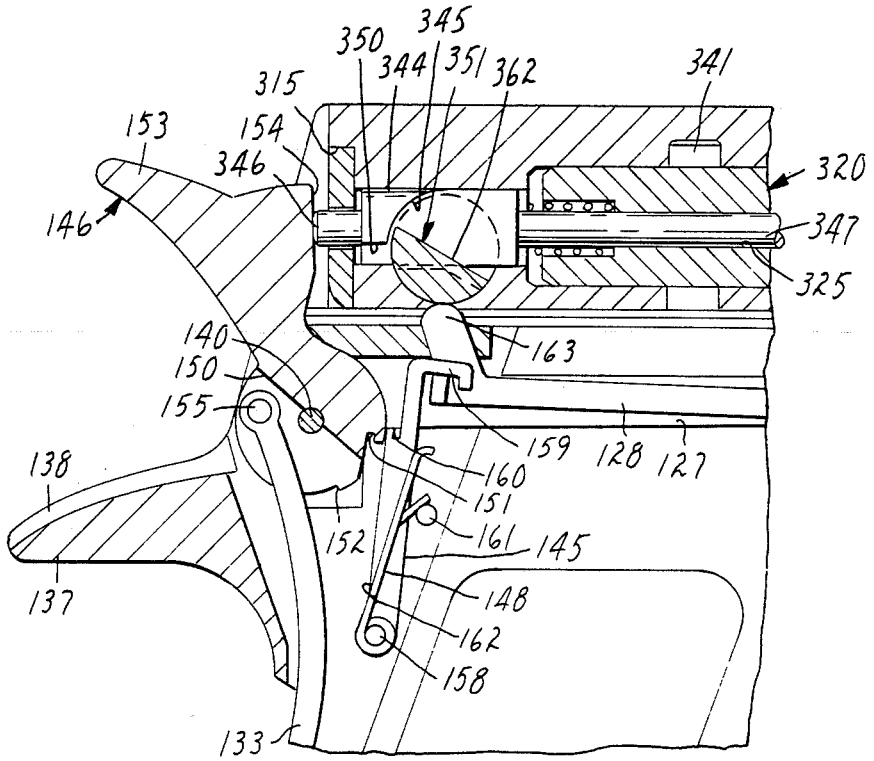
FIG. 9 is an enlarged section view of the hammer end of the pistol of the invention.

The hammer assembly will be better understood with reference to FIGS. 2, 3, and 9. The assembly includes hammer 146, hammer strut 133, hammer strut spring 147, sear lever 145, and sear spring 148.

Hammer 146 is attached to frame assembly by pin 140 and has a recess 150 to receive the hammer strut. The lower portion of the hammer is essentially circular and has a shoulder 151 and a step 152. The upper portion of the hammer has a projection 153 and a striking surface 154.

Hammer strut 133 is curved and is pivotally connected to the hammer by pin 155. The bottom end of the hammer strut rests on surface 156 of magazine catch 136. Shoulder 157 is provided between the ends of the hammer strut. Hammer strut spring 147 is provided on the lower end of the hammer strut between surface 156 and shoulder 157. Spring 147 is constantly under compression to urge the hammer to rotate clockwise about pin 140.

Sear lever 145 and sear spring 148 are pivotally connected to the frame assembly by pin 158. The sear lever has the general shape of an inverted "J" and comprises an upper arm 159 (which cooperates with trigger bar 128) and a notch 160 (which cooperates with shoulder 151 and step 152 of hammer 146).

Sear spring 148 is generally "Y" shaped and constantly urges the sear lever into engagement with the hammer. One end of the sear spring rests against pin 161 while the other end rests against surface 162 of the sear lever.

The barrel assembly 200 (see FIGS. 1, 2, 3 and 4) comprises a hollow cylinder or barrel 201 having a muzzle end 202 and a breech end 203. The muzzle end has front locking assembly 204 while the breech end has rear locking assembly 205. Passage 208 is provided through the wall of the barrel. Fluting 206 may be provided in along the interior surface of the barrel. A foreward sight 207 may also be provided on the barrel.

Front locking assembly 204 projects beneath the muzzle end of the barrel and comprises a housing 209 which defines a chamber 210 closed at one end by means of plug 212 and open at the other. An orifice 211 is provided through the housing which connects chamber 210 to the interior of the barrel by way of passage 208. Piston 213 is located in chamber 210. Piston 213 is slidable between front (see FIG. 2) and rear (see FIG. 3) positions. The piston has a head portion 214 whose diameter is substantially equal to the diameter of chamber 210. The piston further has a body portion 215 whose diameter is such that it can slide through opening 216 in the open end of the housing.

The distance between the muzzle end of barrel 201 and passage 208 is preferably equal to or greater than the length of chamber 210. This maximizes the pressure on, and consequently the momentum imparted to, the piston.

The front locking assembly further includes a support means 217, shown here as horizontal rails, which cooperates with front bearing means of the frame assembly. Grooves 106 slidably receive rails 217. Other support-/bearing means configurations are, of course, possible. A step 218 is also provided in housing 209 which permits the front of the frame assembly to mate thereagainst.

Rear supporting assembly 205 is shown in detail in FIGS. 1, 2, 3, 10, and 11. Assembly 205 projects beneath breech end 203 of the barrel 201 and has a locking means, here shown as vertically curved front surface 219, contoured side surfaces 220, inclined transverse rear surface 221, angled horizontal surface 222, rear support means 223, here shown as horizontal rails, and horizontal rear surface 224.

Surface 219 interacts with a locking mechanism (described hereinafter) to lock the barrel assembly and the frame assembly together. Contoured side surfaces 220 permit springs 112 and spring guides 113 to pass beneath the rear supporting assembly. Support means 223 cooperates with rear bearing means 107 of the frame assembly and are slidably received in the rear bearing means. Notches 108 in the frame assembly facilitate removal of the barrel assembly from the frame assembly.

The barrel locking mechanism will be further understood with reference to FIGS. 2, 3, 7, 8, 10, 11, 25, 26, and 27. The barrel locking mechanism comprises a barrel locking cam 225, a locking pin 226, and a spring 227. The locking cam has channels 228 which permit the passage of springs 112 and spring guides 113. Locking Cam 225 has an indexing plate 229 having a detent 230 which cooperates with the locking pin, a notch 231 which permits end of 232 of the locking pin to pass therethrough, and a lever 233. The locking pin further has head 234 at one end and groove 235 near the other end. Groove 235 is adapted to cooperate with detent 230 of the indexing plate. The locking cam is situated in transverse hole 121 of the frame assembly while the locking pin is situated in transverse hole 122. Transverse hole 122 is enlarged at 122A so as to receive spring 227 and head 234 of the locking pin. Spring 227 is situated around the locking pin between the narrow portion of hole 122 and the head of the locking pin.

When assembled, the locking pin and spring are held in place by placing the detent of the indexing plate in the groove of the locking pin. The action of the spring urges the indexing plate toward the frame assembly of the pistol and holds the cam in position. The barrel locking assembly can be removed from the frame simply by pushing the locking pin toward its end 232 while rotating the cam in a counterclockwise direction by means of the lever. This allows the locking pin to be released from the detent and allows the portion of the locking pin between end 232 and groove 235 to pass through notch 231. Once the top of the lever passes the end 232 of the locking, the pin may be extracted from the frame.

Figure 26:
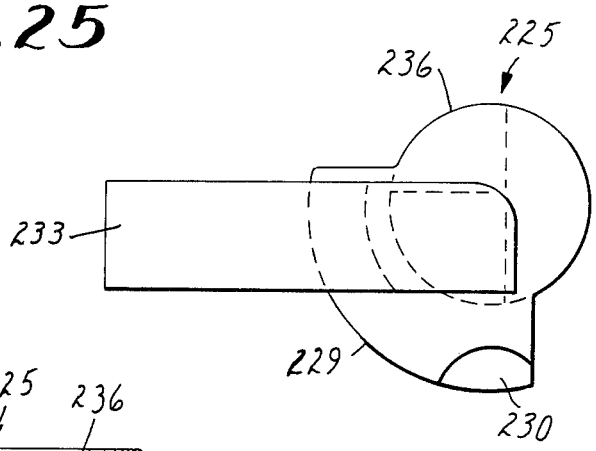
FIG. 26 is an end view of the locking cam of the barrel locking assembly.
Figure 27:
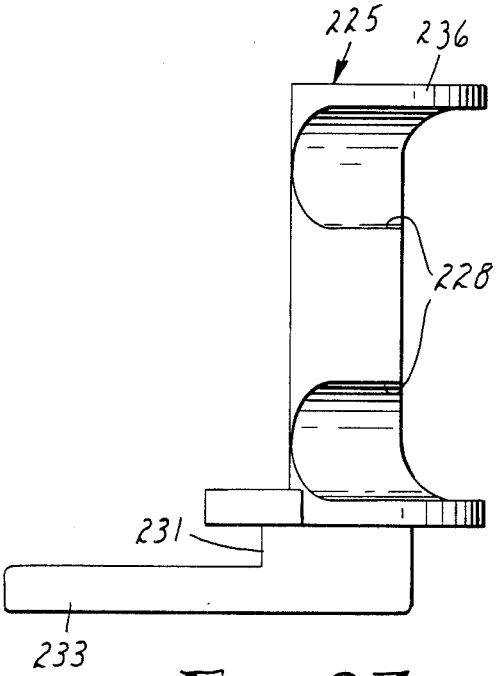
FIG. 27 is a back view of the locking cam of FIG. 26.

FIG. 26 illustrates the locking device in locking position. Thus, surface 236 of the locking cam contacts curved surface 219 of rear supporting assembly 205 of the barrel assembly and forces its rear surface 224 against rear wall 109 of the frame assembly. The net result is that the front of the barrel assembly is supported and locked in position by the ineraction of front bearing means 106 and of the frame assembly and front locking assembly 205 while the rear of the barrel assembly is supported and locked in position by the interaction of rear bearing means 107 of the frame assembly and rear locking assembly 205.

Breech end 203 of the barrel assembly further comprises chamber 237 (see FIGS. 2, 3, 4, 10 and 11) and bolt locking lugs 238. Chamber 237 includes an interior radial channel 239 which receives the lugs from a bolt (see FIG. 10). A recess 240 is provided in a portion of channel 239. The recess extends partially (approximately $\frac{1}{4}$ of the way) around the channel and receives the extractor portion of a bolt and permits the extractor to rotate partially around the breech end of the barrel so that the bolt and the breech end of the barrel may enter into locking engagement.

The bolt carrier assembly is further illustrated in FIGS. 1–3 and 12–13. It comprises barrel-receiving section 301 and bolt-receiving section 302. Vertical side walls 303 are provided which are joined at the front end thereof by lug 304.

Lug 304 has neck portion 305 joined to shoulder portion 306 by curved surface 307. Neck portion 305 is narrower than shoulder portion 306 and fits between springs 112 of biasing means 111. Lug 304 has curved surface 308 which is adapted to slidably receive barrel 201.

The bolt carrier further comprises grooves 309 along its entirety for receiving rails 163; notches 310 for facilitating removal of the rear locking assembly 205 of the barrel assembly; and notches 311 located near the front end thereof. Still further the bolt carrier comprises bolt-receiving cavity 312 for receiving bolt 320, a bolt-retaining pin cavity 316 situated at a right angle to the longitudinal axis of cavity 312, firing pin passage 313, safety drum passage 314, slot 315 for a firing pin stop plate, and passages 317 which ride along the top of walls 104 of the frame assembly. Rounded grooves 318 are provided for receiving disconnectors 163. Inclined surface 319 is also provided on the bottom of the front end of cavity 312.

Bolt 320 (see FIGS. 1–4, 9 and 15–18) comprises locking lugs 321, extractor 322, and ejector 323. It also comprises a firing pin-receiving passage 325 and cam slot 326.

The locking lugs extend beyond face 327 of the bolt and create a cavity for receiving the head of a cartridge. Bottom locking lug 328 is larger than the other lugs and has an inclined surface 329 to facilitate its rearward motion across the top cartridge in the magazine.

Extractor 322 functions to extract a casing from the chamber of the pistol. It is pivotally attached to the bolt by pin 330. Additionally, it has spring 331 between slot 332 in the extractor and the floor of the extractor-receiving cavity 333.

Ejector 323 functions to eject the extracted casing from the pistol. The ejector is held in cavity 334 by a pin 335 which slides into depression 336 in the ejector.

Bolt locking mechanism 324 (see FIG. 18) is provided in the bolt carrier assembly and comprises an outer, hollow body 337, spring guide 338 and spring 339 which are all received in cavity 340. Spring 339 and pin 338 are moveably received in cavity 340. Spring 339 urges body 337 away from spring guide 338 and between both locking lugs 321.

Cam slot 326 has a compound helical surface and cooperates with fixed pin 341 (see FIGS. 2 and 3) to cause the bolt to rotate in a counterclockwise direction during the rearward motion of the bolt carrier thereby unlocking locking lugs 321 of the bolt from the bolt locking lugs 238 of the barrel and permitting the bolt to be withdrawn from the breech end of the barrel. During this rearward motion of the bolt the cartridge case in the chamber is removed by extractor 322 and ejected from the pistol by ejector 323. Once the cartridge case has been ejected, a new round is urged from the magazine into longitudinal registry with the chamber.

Cam slot 326 and pin 341 also cooperate to cause the bolt to rotate in a clockwise direction during the foreward motion of the bolt carrier thereby permitting the locking lugs 321 of the bolt to engage the bolt locking lugs 238 of the barrel. During this foreward motion of the bolt, the new round is contacted by face 327 of the bolt and pushed into the chamber.

Figures 12, 13, 14, 19, 20, 21:
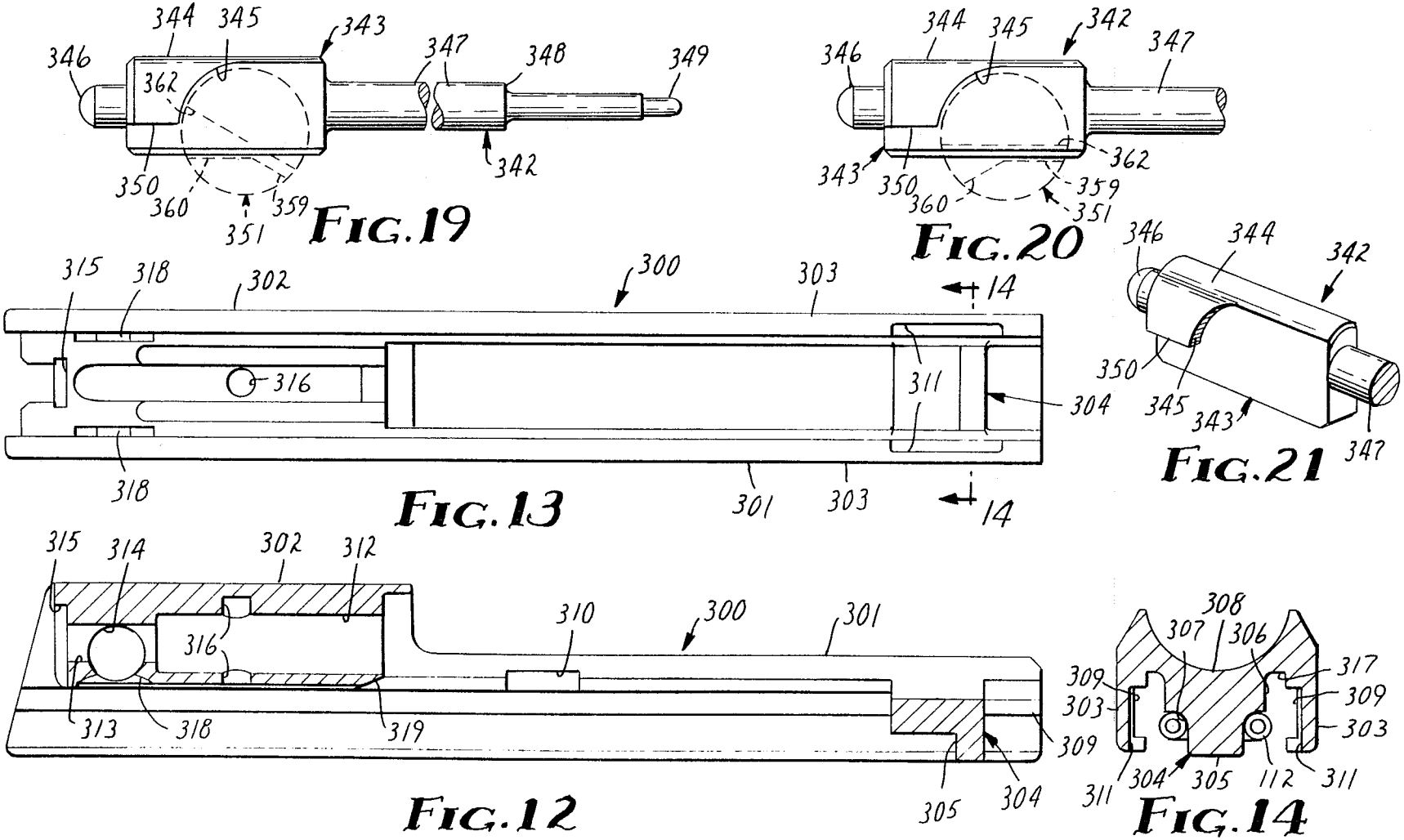
FIG. 12 is a vertical section view of the bolt carrier of the pistol of FIG. 1.
FIG. 13 is a bottom view of the bolt carrier of FIG. 1.
FIG. 14 is an enlarged section view of the bolt carrier of FIG. 13 taken along line 14—14.
FIG. 19 is a view of one embodiment of the firing pin useful in the invention showing the safety drum (shown in phantom) in a safe position.
FIG. 20 is a view of one end of the end of the firing pin of FIG. 19 with the safety drum (shown in phantom) in a ready position.
FIG. 21 is a perspective view of the hammer-striking end of the firing pin of FIG. 20.
Figure 25:
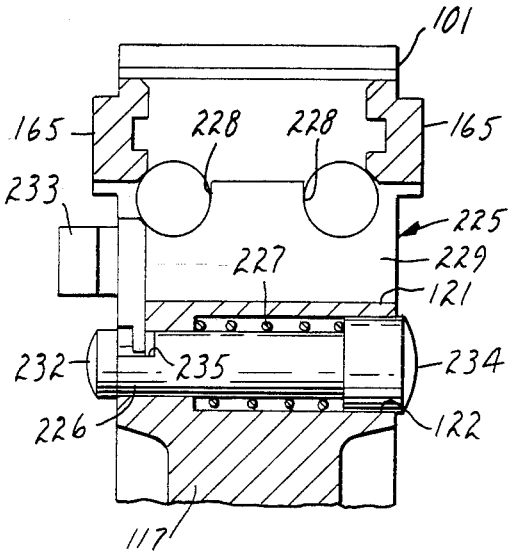
FIG. 25 is a section view of the trigger guard of the pistol of the invention showing the barrel locking assembly.

Firing pin 342 is shown in detail in FIGS. 19–21. It comprises a body portion 343 having a shoulder portion 344. Curved surface 345 and flat surface 350 are each provided on shoulder portion 344. The firing pin also has hammer striking nipple 346 and elongate neck 347. The diameter of neck 347 is reduced at 348. Neck 347 terminates in cartridge striking nipple 349.

Figure 22:
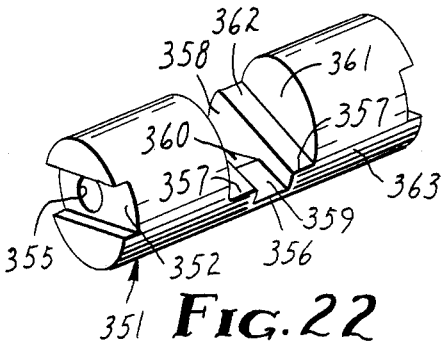
FIG. 22 is a perspective view of the safety drum utilized in FIGS. 20 and 21.

Safety drum 351 is shown in FIG. 22. It is generally cylindrical in nature and has a series of grooves provided therein. Grooves 352 receive a safety lever 353 (see FIG. 1) which controls the position of the drum. The safety lever is secured to the safety drum by means of screw 354 (see FIG. 1) received in threaded hole 355. Grooves 356 and 357 are provided transversely of the longitudinal axis of the safety drum. Groove 356 is located along the longitudinal axis of groove 357 and has side walls 358, horizontal floor 359 and sloping floor 360. Floors 359 and 360 intersect with each other at the longitudinal axis of the safety drum. Groove 357 has side walls 361 and floor 362.

The firing pin and safety drum are adapted so that the narrow part of the body portion fits within groove 356 while the shoulder portion fits within groove 357. When the safety drum is in the safe position (see FIG. 19), inclined floor 360 is rotated to the horizontal and into contact with the bottom of the body portion 343 of the firing pin. Additionally, curved surface 363 of the safety drum is brought into contact with curved surface 345 of the firing pin. This contact prevents any forward travel of the firing pin.

Slots 241 are also provided in the safety drum (see FIG. 1). These slots receive disconnectors 163 of the trigger bar when the safety drum is in the safe position preventing the trigger bar 128 from engaging the sear lever (see FIG. 2). This prevents the trigger from disengaging the sear lever. They thereby serve as an additional safety feature.

When the safety drum is in the ready position (see FIG. 20), inclined floor 360 is rotated away from the bottom of the body portion of the firing pin. In this position horizontal floor portion 359 is in slidable contact with the bottom of the body of the firing pin. Furthermore, shoulder portion 344 of the firing pin is slidably received in groove 357 of the firing pin so that surface 350 of the firing pin can slide across floor 362 of the safety drum.

Figure 23:
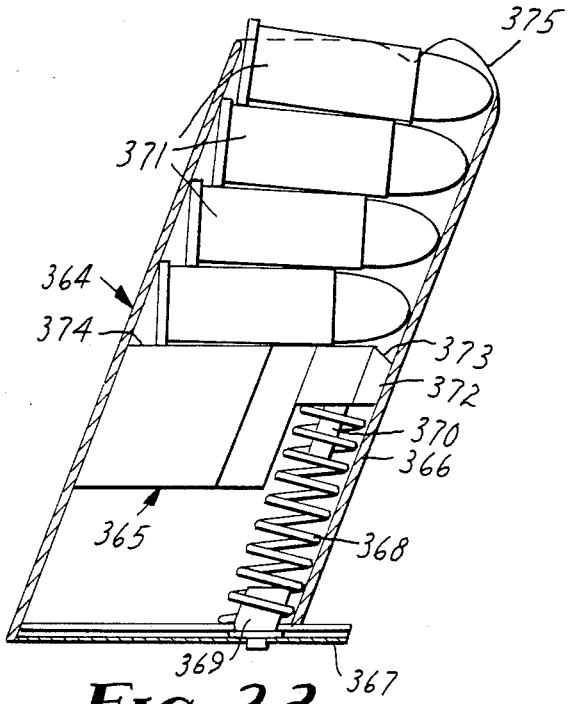
FIG. 23 is a section view of a magazine useful with the pistol of the invention.
Figure 24:
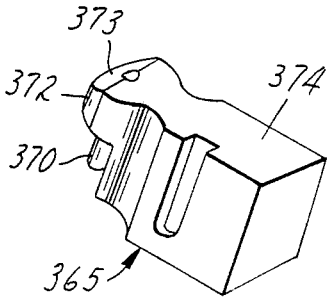
FIG. 24 is a perspective view of a follower plate useful in the magazine of FIG. 23.
Figure 11:
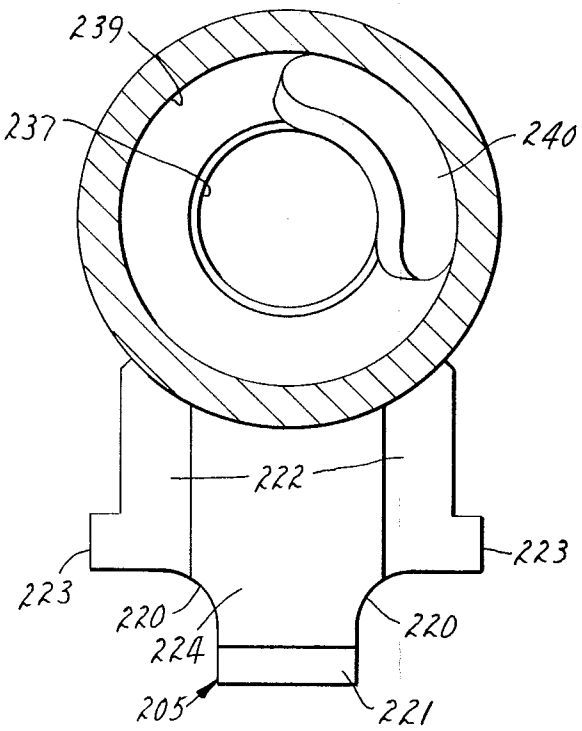
FIG. 11 is a section view of the breech end of the barrel assembly of FIG. 10 taken along line 11—11.
Figure 10:
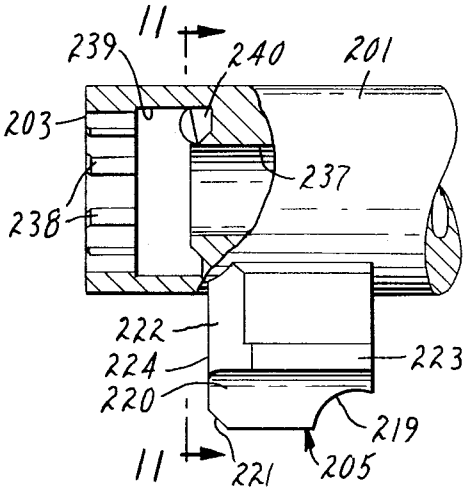
FIG. 10 is an enlarged detail view, partially in section, of the breech end of the barrel assembly.
Figure 15:
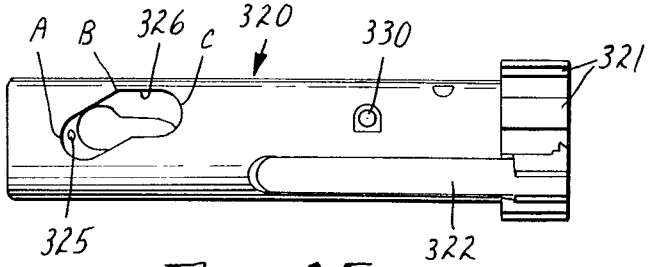
FIG. 15 is a side view of one embodiment of a bolt useful in the invention.

FIGS. 23 and 24 show a preferred embodiment of a magazine 364 and a follower 365 useful therein. The magazine comprises a housing 366 which is open at the top and closed at the bottom by plate 367. The follower and bullets 371 are urged upward in the magazine by means of spring 368. Post 369 secured to plate 367 and post 370 on the follower are inserted into opposite ends of the spring to keep it in position. Additionally, the opposed walls of the housing are indented to define a generally circular chamber to assist in retaining the spring in position.

The follower further has a rounded front end 372 which fits within the circular chamber of the magazine. Additionally, it has top surface 373 and sloped surface 374. Surface 374 is slightly inclined fron one side to the other to facilitate stacking of successive rounds within the magazine. Surface 373 is sloped so as to generally match the curvature of the top of the magazine at 375.

The operation of the pistol of the invention is now described. With the pistol in the battery position (see FIG. 2), the hammer 146 is cocked thereby disengaging the sear 145 from the sear notch 151 and engaging it on the sear step 152. The trigger 120 is then pulled. This pulls the trigger bar 128 and the sear 145 (connected to the trigger bar by upper arm 159) foreward and free from the sear step 152. The hammer strut 133 and the hammer strut spring 147 urge the hammer clockwise so as to strike the hammer striking nipple 346 of the firing pin.

The impact of the hammer on the firing pin causes the firing pin to strike the casing in the chamber 237 of the barrel assembly 200 thereby detonating the propellant in the casing. Gasses generated by the burning propellant are essentially completely contained within the barrel 201 as the bullet travels down it and pressurizes this volume. When the gasses reach the passage 208 and orifice 211, at least a portion thereof are vented into chamber 210 and pressurize it. The pressure in chamber 210 imparts momentum to piston 213 and forces it to strike lug 304 of the bolt carrier assembly.

The impact of the piston on the lug urges the bolt carrier toward the rear and against the action of the springs 112. As the bolt carrier moves rearward along rails 165, bolt 320 remains in locked engagement with the barrel assembly until the bolt carrier moves pin 341 from position A to position B. During this travel, the pin causes the bolt to rotate in a counterclockwise direction until it is unlocked from the barrel assembly. As the bolt carrier continues to move rearward, pin 341 moves from position B to position C. Subsequent rearward motion of the bolt carrier then withdraws the bolt from the barrel assembly.

As the bolt is withdrawn from the barrel assembly, the ejector 323 pulls the casing from the chamber. Once the casing clears the chamber 237, the ejector ejects it from the pistol. Essentially simultaneous with this ejection, a new round is urged from the magazine and into registry with the chamber 237 for insertion therein upon foreward travel by the bolt carrier.

Additionally, as the bolt carrier moves rearward, it recocks the hammer 146 and forces the disconnectors 163 on trigger bar 128 down and disengages the trigger bar from the upper arm 159 of the sear. This enables the sear to return to its rear position with sear notch 160 in contact with sear step 152 of the now recocked hammer.

Upon reaching the end of its rearward travel, the bolt carrier is urged foreward by the action of the springs 112 of the biasing means. As it travels foreward the bolt carrier reloads the gun by causing the bottom lug on the bolt 320 to strip the top round from the magazine and insert it into the chamber. Ramp 164 in the magazine well facilitates insertion.

During foreward motion pin 341 moves from position C to position B (see FIG. 15) causing the bolt to be inserted into the breach end of the barrel assembly. As pin 341 continues to move from position B to position A, the bolt is caused to rotate in a clockwise direction so as to become locked into the breech end of the barrel assembly.

As the bolt carrier completes its foreward travel it allows the disconnectors and the trigger bar to return to their elevated position so that, once pressure on the trigger is released, the trigger bar may reengage the upper arm of the sear. Furthermore, completion of its foreward travel causes the piston to return to its forward position in chamber 210. The pistol is then ready to be fired again by merely pulling the trigger.

I claim:

1. A gas operated pistol comprising:

(A) a frame assembly having a forward trough-shaped portion and breech end bearing means comprising first horizontal grooves, (B) resilient biasing means in said trough-shaped portion of said frame assembly, (C) a barrel assembly having means for securing said barrel assembly to said frame assembly and comprising:

(1) a barrel in said forward trough-shaped portion having muzzle and breech ends, (2) a passage through the wall of said barrel, (3) a muzzle locking assembly projecting beneath the muzzle end of said barrel and supported in the forward end of said trough-shaped portion of said frame assembly, said muzzle locking assembly including a housing defining a chamber with an opening into said trough-shaped portion of said frame assembly, and an orifice connecting said passage to the muzzle end of said chamber, (4) a breech locking assembly projecting beneath the breech end of said barrel and supported by said breech end bearing means in the rearward end of said trough-shaped portion of said frame assembly, said breech end locking assembly comprising (i) a vertically curved muzzle-facing cam surface, (ii) a locking cam pivotable on said frame to engage said cam surface to secure said barrel assembly to said frame and (iii) first horizontal locking rails on opposed vertical sides of said breech locking assembly for engagement in said first horizontal grooves in said breech end bearing means, (D) a bolt carrier assembly slidable on said frame assembly, said bolt carrier assembly comprising a rearward bolt section aligned with said barrel, and a forward barrel-receiving section having a lug connecting spaced vertical side walls, said lug being positioned in said forward trough-shaped portion of said frame assembly, and said bolt carrier assembly being urged toward the muzzle end of said pistol by said resilient biasing means, and (E) a piston slidable in said chamber in said muzzle locking assembly, said piston projecting out of said chamber and engaging said lug on said bolt carrier.

2. A pistol according to claim 1 wherein said frame assembly further comprises muzzle end bearing means which supports said muzzle locking assembly.

3. A pistol according to claim 2 wherein said muzzle locking assembly further comprises second horizontal rails on opposed vertical sides of said housing and wherein said muzzle end bearing means comprises second horizontal grooves to engage said second horizontal rails.

4. A pistol according to claim 1 wherein the distance from the muzzle end of said barrel to the inlet to said passage through said wall of said barrel is equal to or greater than the length of said chamber.

5. A pistol according to claim 1 wherein said resilient biasing means comprises a pair of parallel springs disposed around spring guides.

6. A pistol according to claim 1 wherein said bolt carrier assembly further comprises a bolt having a transverse helical slot therethrough for causing said bolt to rotate about its longitudinal axis during rearward movement of said bolt carrier assembly (a) to unlock said bolt from said barrel assembly and (b) to withdraw said bolt from said barrel assembly.

7. A pistol according to claim 6 wherein said transverse helical slot comprises a first portion parallel to the longitudinal axis of said bolt and a second portion which intersects said first portion at an angle thereto.

* * * * *